US009427036B2

(12) United States Patent
Key

(10) Patent No.: US 9,427,036 B2
(45) Date of Patent: Aug. 30, 2016

(54) ADJUSTABLE FASHION BELT

(71) Applicant: Lia Key, Philadelphia, PA (US)

(72) Inventor: Lia Key, Philadelphia, PA (US)

( * ) Notice: Subject to any disclaimer, the term of this patent is extended or adjusted under 35 U.S.C. 154(b) by 0 days.

(21) Appl. No.: 14/566,861

(22) Filed: Dec. 11, 2014

(65) Prior Publication Data

US 2016/0165986 A1 Jun. 16, 2016

(51) Int. Cl.
*A41F 9/02* (2006.01)
*A41F 9/00* (2006.01)

(52) U.S. Cl.
CPC *A41F 9/025* (2013.01); *A41F 9/02* (2013.01)

(58) Field of Classification Search
CPC ..... A41F 9/02; A41F 9/00; A41F 1/008; A41F 15/002; A41F 15/02; A41F 17/02; A41F 9/025; A45F 5/021; A45F 5/00; A45F 5/02; A45F 2005/008; A45F 2003/045; A45F 2003/144; A45F 3/005; Y10T 24/2155; Y10T 24/40; Y10T 24/4088; Y10T 24/4093; Y10T 24/45262; A41D 1/06; A41D 13/0015; A41D 2200/10; A41D 2400/38; A41D 2400/44; A41D 2600/10; A44B 11/006; A44B 11/005; A44B 11/22; A44B 17/0064; A44C 5/0053
See application file for complete search history.

(56) References Cited

U.S. PATENT DOCUMENTS 7,373,696 B2 * 5/2008 Schoening ..... A41D 25/003 24/303
2001/0016526 A1 * 8/2001 Tate ..... A01K 97/06 473/406
2001/0044949 A1 * 11/2001 Brunson ..... A41D 19/01594 2/160
2004/0069828 A1 * 4/2004 Turner ..... A45C 11/22 224/660
2005/0039244 A1 * 2/2005 Goldfarb ..... A41F 9/002 2/338
2005/0102802 A1 * 5/2005 Sitbon ..... A41F 1/002 24/303
2005/0150034 A1 * 7/2005 Marks ..... A41F 9/002 2/338
2005/0150035 A1 * 7/2005 Marks ..... A41F 9/002 2/338
2006/0016841 A1 * 1/2006 Shurm ..... A45F 5/00 224/222
2008/0083136 A1 * 4/2008 McNeely ..... A41F 17/02 36/70 R
2008/0185414 A1 * 8/2008 Conlon ..... A45F 5/02 224/674
2009/0007316 A1 * 1/2009 Escudero Munoz ..... A41F 1/00 2/300
2009/0020571 A1 * 1/2009 Toman ..... A45F 5/00 224/255
2009/0095785 A1 * 4/2009 Woolery ..... A41D 13/0012 224/665
2009/0139014 A1 * 6/2009 Trochlil-Crist ..... A41F 9/002 2/338
2009/0314813 A1 * 12/2009 Woolery ..... A45F 5/02 224/183
2011/0247201 A1 * 10/2011 d'Auriac ..... A41D 27/08 29/700
2012/0216374 A1 * 8/2012 Manuello ..... A41F 1/002 24/303

* cited by examiner

*Primary Examiner* — Bobby Muromoto, Jr.
(74) *Attorney, Agent, or Firm* — Stuart M. Goldstein

(57) ABSTRACT

An adjustable fashion belt has elongated outer and inner layers of material secured in adjacent alignment to each other. A strip of ferromagnetic material extends between substantially the length of the layers. Magnets are secured at the ends of the layers. The wearing circumference of the belt can be varied, according to the waist size of the user, and secured in position by encircling the wearer and then by placing the magnets on selected locations on the outer surface of the belt, where they are attracted to the ferromagnetic metal strip. One or more belt ornament components are provided, each having a magnetic section an ornament section. The magnet section of the belt ornament component is positioned on the outer surface of the belt and is removeably attracted to the belt by the ferromagnetic metal strip.

4 Claims, 3 Drawing Sheets

ADJUSTABLE FASHION BELT

BACKGROUND OF THE INVENTION

There are many different types of belts into which magnets are incorporated. Such belts primarily comprise magnets utilized for therapeutic or medical purposes. Other belts have magnets to secure loose ends of the belt to the belt's surface. However, there are currently no belts which use magnets specifically for positioning and maintaining a belt to accommodate the sizes of different wearers and which allow belts to be positioned around different parts of a wearer's body. There are also no belts utilizing magnetic ornamental belt components to enhance the design and fashion appearance of the belt.

SUMMARY OF THE INVENTION

It is thus the object of the present invention to provide an adjustable fashion belt which utilizes magnets to vary the wearing circumference of the belt to accommodate the size of the wearer and to allow the positioning of the belt around different parts of the wearer's body.

It is another object of the present invention to provide an adjustable fashion belt which offers the versatility of attaching a variety of belt ornament components to the belt.

These and other objects are accomplished by the present invention, an adjustable fashion belt having elongated outer and inner layers of material secured in adjacent alignment to each other. A strip of ferromagnetic material extends between substantially the length of the layers. Magnets are secured at the ends of the layers. The wearing circumference of the belt can be varied, according to the waist size of the user, and secured in position by encircling the wearer and then by placing the magnets on selected locations on the outer surface of the belt, where they are attracted to the ferromagnetic metal strip. One or more belt ornament components are provided, each having a magnetic section and an ornament section. The magnet section of the belt ornament component is positioned on the outer surface of the belt and is removeably attracted to the belt by the ferromagnetic metal strip.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
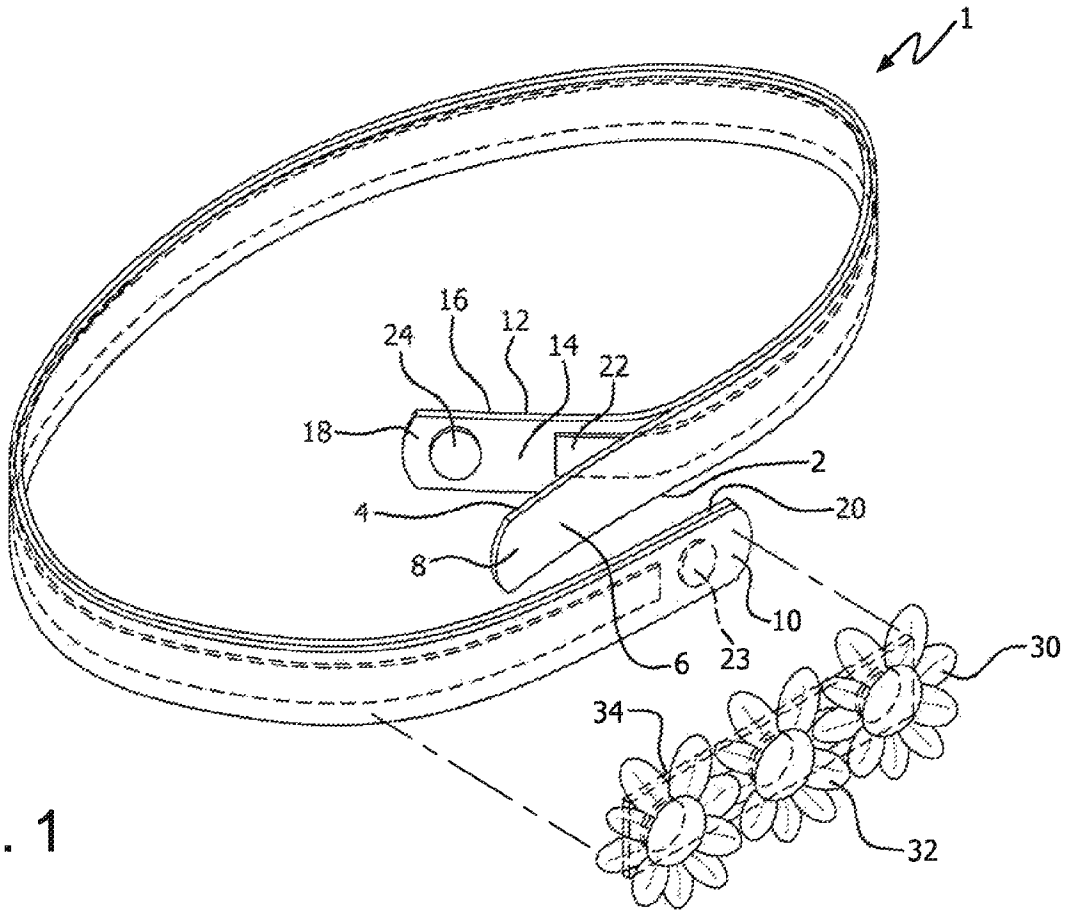
FIG. 1 is an exploded view of the components of the present invention.
Figure 2:
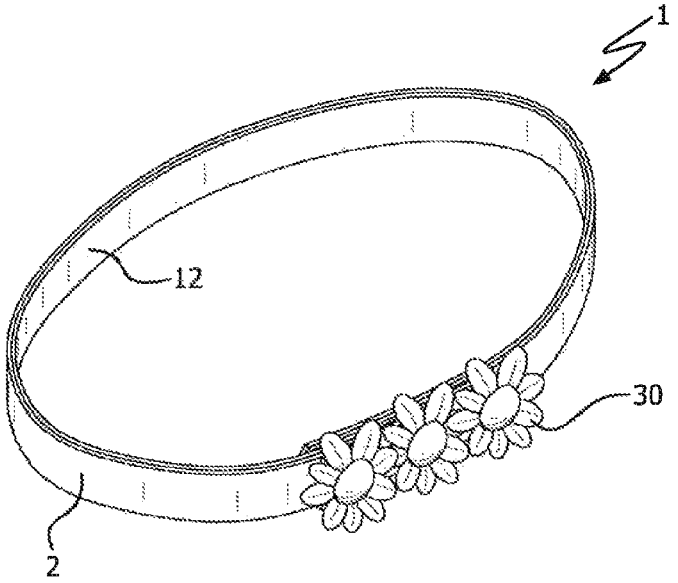
FIG. 2 is an isometric view of the present invention.
Figure 3:
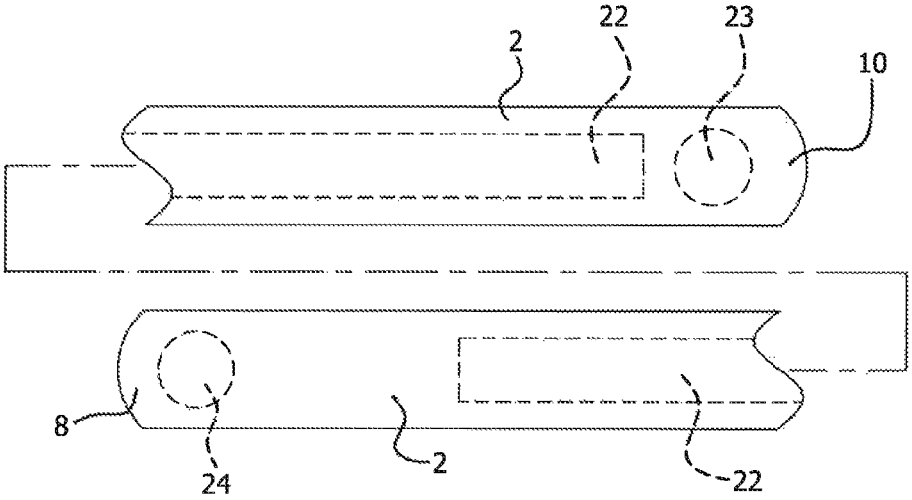
FIG. 3 is an elevation of the belt component of the present invention.
Figure 4:
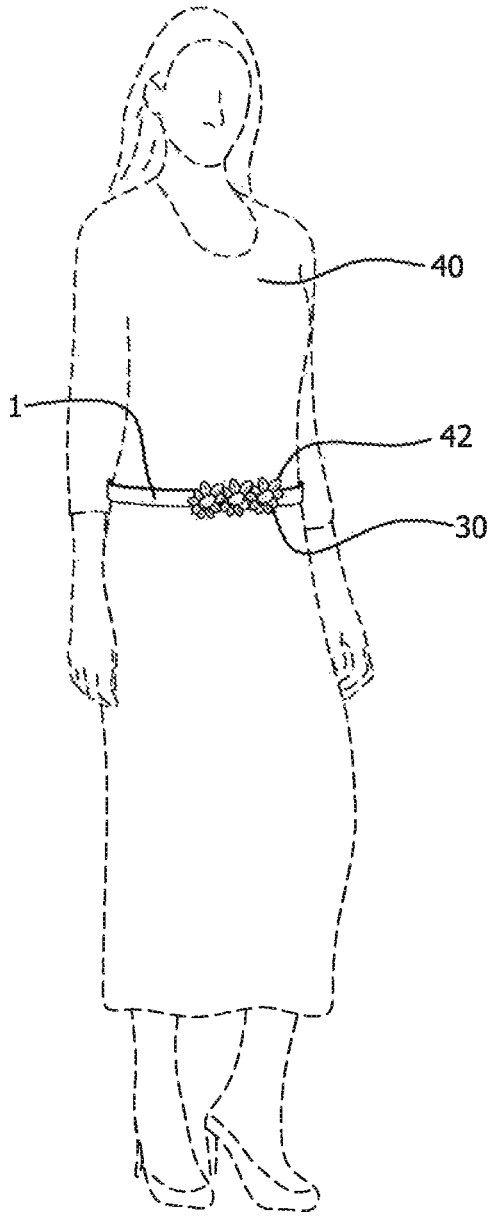
FIG. 4 shows the present invention positioned on the waist of a wearer.

Adjustable fashion belt 1 comprises elongated outer material layer 2 having inner surface 4, outer surface 6, and end sections 8 and 10. Belt 1 also comprises elongated inner material layer 12 having inner surface 14 and outer surface

16, and end sections 18 and 20. Outer layer 2 and inner layer 12 can be fabricated from leather, cloth, or equivalent material. Outer layer 2 and inner layer 12 are attached to each other by glue, epoxy, sewn connection, or equivalent means such that each layer and their respective end sections are adjacently aligned.

Elongated metal strip 22 extends between outer layer 2 and inner layer 12, for substantially the length of the layers. Strip 22 is made of a flexible, ferromagnetic material, which is readily attracted to a magnet. Examples of such materials are iron, nickel, cobalt, and alloys of these metals.

Magnet 24 is located at and secured to either end section 8 of outer layer 2 or end section 18 of inner layer 12. FIG. 1 shows magnet 24 secured to end section 18. Magnet 23 is located at and secured to either end section 10 of outer layer 2 or end section 20 of inner layer 12. Magnets 23 and 24 have sufficient magnetic force to attract and securely connect the magnet to ferromagnetic strip 22 located between outer layer 2 and inner layer 12. It is contemplated that only one of magnets 23 and 24 could be utilized. However, the use of two magnets will provide a more secure attachment of belt 1 around the body of the wearer.

Fashion belt 1 can thus be adjustably positioned and secured in many different sized wearing circumferences. This allows belt 1 to accommodate the waist sizes of different wearers, depending where on outer surface 6 of outer layer 2 magnet 24 is placed. Once belt 1 is positioned such that it encircles the waist 42 or other part of the body of wearer 40, magnets 23 and 24 are placed at the appropriate locations on outer surface 6, where they are attracted to ferromagnetic metal strip 22 to maintain the belt on the wearer.

Ornamental belt component 30 comprises decorative section 32 and magnet section 34 consisting of a magnet. After fashion belt 1 is attached around wearer 40, ornamental belt component 30 can be added simply by placing magnet section 34 against the belt. Ornamental belt component 30 is thereby maintained on belt 1 by the attraction of magnet section 34 to ferromagnet metal strip 22 within the belt. Ornamental belt component 30 can be positioned as a belt buckle or on any location on the exterior of belt 1 itself.

Thus fashion belt 1 of the present invention can be utilized by wearers having a multitude of different waist sizes. It can also be positioned around parts of the body other than the waist, including the upper torso and hips. In addition, ornamental belt components can be fabricated of infinite sizes, shapes, designs, and colors, to enhance the look of the belt in a vast variety of ways in any number of locations on belt 1. The design of fashion belt 1 allows it to be reversible, providing the belt with even more versatility.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. An adjustable fashion belt for encircling the entire body of a wearer, said belt comprising:

an elongated outer material layer having inner and outer surfaces and first and second end sections, said outer layer extending the length of the belt;

an elongated inner material layer, a different component of the belt, separate and independent of the outer layer, said inner layer having an inner surface and two end sections, said inner layer extending the length of the belt, the inner surface of the outer layer being attached to the inner surface of the inner layer such that each layer and their respective end sections are adjacently aligned;

a magnet located between the outer and inner layers at the first of the adjacently aligned end sections; and an elongated strip of ferromagnetic metal extending substantially the lengths of and between the outer layer and the separate and independent inner layer, whereby the end section of the belt in which the magnet is located is positionable at multiple locations on the outer surface of the outer layer of the belt in order to vary the wearing circumference of the belt and to secure the belt around the entire body of a wearer at said variety of wearing circumferences.

2. The adjustable fashion belt as in claim 1 further comprising at least one ornamental belt component connected to the outer layer of the belt, said ornamental belt component comprising a decorative section and a magnet section, the ornamental belt component being removeably fastened to the outer layer by the attraction of the magnet section to the ferromagnetic metal strip within the belt.

3. The adjustable fashion belt as in claim 1 further comprising a second magnet located between the outer and inner layers at the second of the adjacently aligned end sections.

4. The adjustable fashion belt as in claim 2 further comprising a second magnet located between the outer and inner layers at the second of the adjacently aligned end sections.

* * * * *